United States Patent [19]

Alter et al.

[11] 4,400,907

[45] Aug. 30, 1983

[54] MOUNTING HARNESS FOR AN AMUSEMENT BALL DEVICE

[76] Inventors: Bernard Alter, 923 N. Pass Ave., Burbank, Calif. 91505; Fred Rhyme, 126 E. Spruce St., Compton, Calif. 90220

[21] Appl. No.: 312,734

[22] Filed: Oct. 19, 1981

[51] Int. Cl.[3] ..... A63H 3/50

[52] U.S. Cl. ..... 46/32; 46/51; 273/DIG. 19

[58] Field of Search ..... 46/51, 47, 1 R, 32; 84/421; 273/DIG. 19, DIG. 17, DIG. 18; 272/78, 94; 224/910

[56] References Cited

U.S. PATENT DOCUMENTS

| | | | |
|---|---|---|---|
| 2,191,683 | 2/1940 | Roberts | 273/DIG. 17 |
| 3,157,961 | 11/1964 | Payne | 46/51 |
| 3,200,536 | 8/1965 | Petitto, Sr. | 46/51 |
| 3,326,551 | 6/1967 | Clarke | 46/47 X |
| 3,342,482 | 9/1967 | Paolone | 46/51 X |

*Primary Examiner*—Mickey Yu
*Attorney, Agent, or Firm*—Erik M. Arnhem

[57] ABSTRACT

An amusement and exercise ball has an improved simplified harness securing the device to the human body, having a flexible single mounting plate for a hoop, a single body harness strap permanently secured at a first strap terminus to a first end of the mounting plate, and an adjustable buckle secured at a second strap terminus and fastening to the mounting plate hook second terminus. The hoop of the device is centrally and rotatably secured on the mounting plate. The mounting plate hook second terminus is integral with the plate. The adjustable buckle has a terminal narrow strap slot, a parallel mid-wider strap slot, and a terminal slot adapted and sized to secure to the mounting plate hook second terminus. The hoop is slidably rotatable by finger tips to any angular position on the mounting plate, being functionally held in position by a clamp washer, and a locking collar.

3 Claims, 4 Drawing Figures

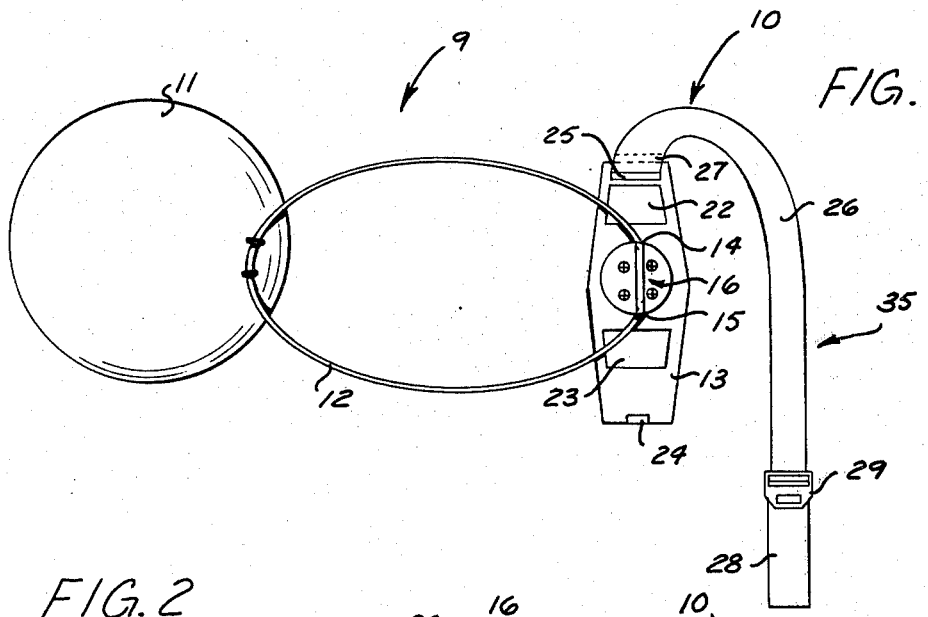
FIG. 1
FIG. 2
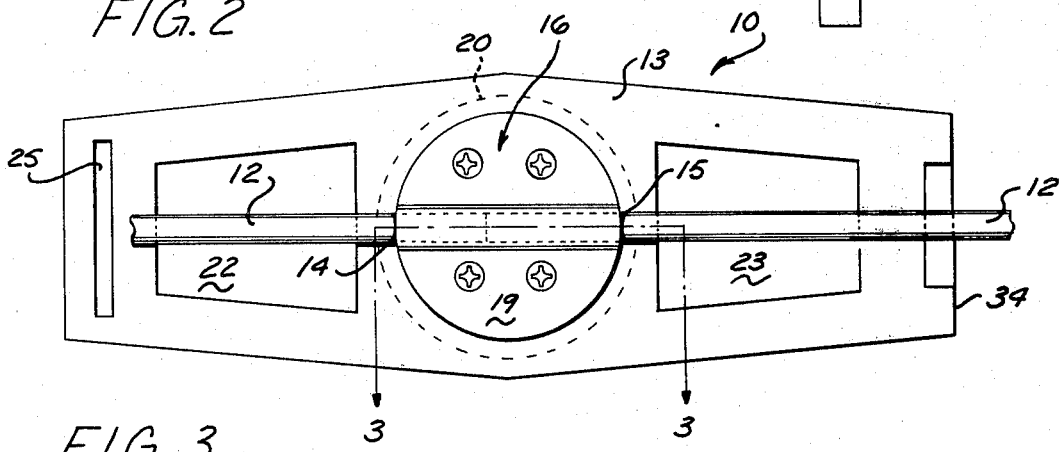
FIG. 3
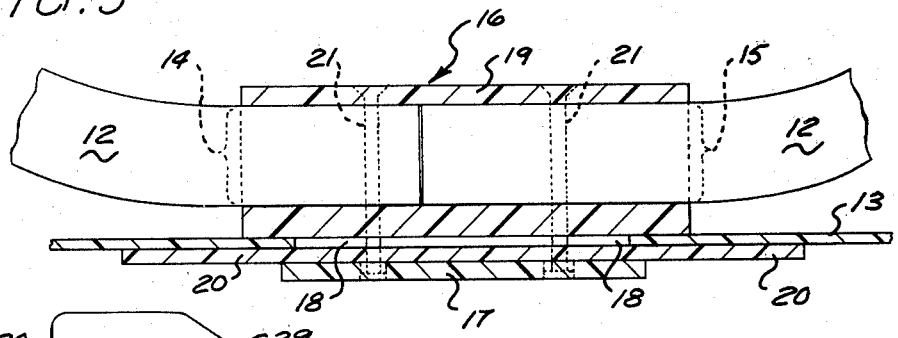
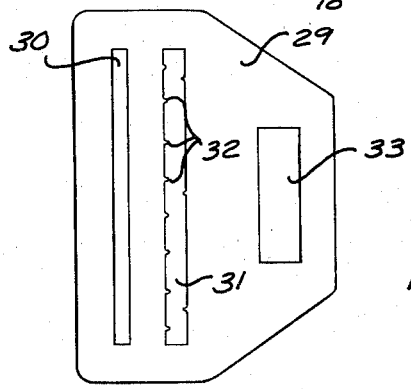
FIG. 4

MOUNTING HARNESS FOR AN AMUSEMENT BALL DEVICE

BACKGROUND OF THE INVENTION

The improved amusement ball device of this invention is classified in Class 46, sub class 51.

Payne, in U.S. Pat. No. 3,157,961, issued Nov. 24, 1964, disclosed an amusement and exercise device which may be detachably secured to a human body, as at the waist or other body position, and embodies a ball so mounted on a hoop as to be rotatable on gyrating the body. The device can be strapped about the body waist, or the like, and has a hoop secured to the body strap. The ball is rotatably secured to the hoop.

SUMMARY OF THE INVENTION

Further improvements are disclosed in the earlier U.S. Pat. No. 3,157,961 issued Nov. 24, 1964, wherein a simplified improved mounting harness secures this amusement ball device to a user's body, as at the waist or the like. A further modification enables the user to rotate the hoop at any angular attitude on the mounting plate of the harness. The mounting harness has a flexible single mounting plate for a hoop centered on said plate, a first terminus of a single body harness wide strap is permanently secured to a first terminus of said mounting plate, and an integral hook extends from a second opposed terminus of said mounting plate. A second adjustable terminus of the harness wide strap has a slidable, adjustable buckle thereon, the buckle having a first terminal narrow strap slot, a parallel mid-wide strap slot, and a second terminal slot adapted and sized to secure to the integral hook of the second opposed terminus of the mounting plate.

The hoop mounting modification is secured mid-section on the harness mounting plate. The hoop termini are secured together and frictionally secured through the two apertures in the opposed walls of a shallow holding chamber. An internally fitting collar having matching opposed hoop securing apertures is frictionally locked to the second and opposed face of the mounting plate, by locking and securing bolts and nuts which lock the collar, the pair of hoop termini, the shallow holding chamber, and a flat top for the holding chamber into an integral whole. A frictionally slidable flat split washer is disposed in a groove in the collar and between the mounting plate, providing a frictionally rotatable grip for the rotation of the hoop holding assembly by the user's finger tips.

Included in the objects of this invention are:

To provide an improved and easily rotatable hoop mounting for the amusement ball device.

To provide a simplified and low cost body securing strap means for an amusement ball device.

To provide a body harness strap assembly for an amusement ball device having a minimum number of component parts.

To provide a simple and low mechanical skill manipulative means for securing and adjusting a hoop for an amusement ball device.

Other objects and advantages of this invention are taught in the following description and claims.

BRIEF DESCRIPTION OF THE DRAWINGS

The description of this invention is to be read in conjunction with the following drawings:

FIG. 1 is a perspective elevational view of the amusement ball device having an improved mounting harness.

FIG. 2 is a plan view of the mounting plate assembly.

FIG. 3 is a sectional view through 3—3 of FIG. 2, illustrating the hoop holding assembly.

FIG. 4 is a plan view of the adjustable buckle of the mounting harness.

DESCRIPTION OF THE PREFERRED EMBODIMENT OF THE INVENTION

FIG. 1 is an elevational perspective view of the new mounting harness 10 of the old amusement device 9 disclosed in U.S. Pat. No. 3,157,961 issued Nov. 24, 1964. This new invention relates to the improvement in harness 10 as partially illustrated in FIG. 2.

The inflated ball 11 is rotatably secured to the circular hoop 12, which is secured in and to the harness mounting plate 13. The circular hoop 12 is formed of circularly bent tubing, joined by a single inner plug secured in both tubing termini. The hoop 12 is adaptively secured through two slot apertures 14 and 15 opposed in the wall of the shallow holding chamber 16. The shallow holding chamber 16 has an externally fitting collar 17 shown in FIG. 3, which is positioned and locked in position on the mounting plate 13 through an aperture 18, which is sized to allow the insertion of the smaller diameter collar 17 then through aperture 18. The hoop 12 termini secured in the slot apertures 14 and 15 of the holding chamber 16 are secured and clamped by the shallow holding chamber top 19. The chamber 16 is mounted on plate 13 and the external collar 17 is slipped through the aperture 18, and frictionally rotatably secured in position by the large diameter frictional split plastic washer 20, which fits between the plate 13 and collar 17 and locks the shallow chamber 16 and collar 17 into a rotatable position through aperture 18.

The top aperture of chamber 16 is closed and secures the hoop 12 by a chamber top 19, which also secures the hoop 12 tightly in position. The top 19 is secured by long bolts and locking nuts 21 to the collar 17.

The two apertures 22 and 23 in mounting plate 13 provide additional flexibility to plate 13. An integral hook is formed in plate 13 at hook 24, formed by folding a portion of plate 13 back on itself (FIG. 2). The mounting plate 13 can be a selected tough plastic, such as high density polyethylene, polypropylene, polycarbonate, polyvinyl, or the like, or it can be steel, aluminum sheet or the like. Other components, such as the holding chamber 16 can be molded plastic.

A first terminus slot 25 is disposed in the mounting plate 13 providing a permanent attachment slot for the single wide body harness plastic strap 26 conventionally secured through slot 25 and shown at a strap first terminus 27 to the strap 26. A second strap terminus 28 of strap 26 has an adjustable slidable buckle 29 (see also FIG. 4) slidably secured thereon 26.

The buckle 29 has a first terminal narrow slot 30 disposed therein 29 of a width slidably accepting the strap 26. A second parallel mid-width strap slot 31 has projections 32 extending into slot 31 which secure the strap 26, preventing its easy slippage. A second terminal slot 33 is adapted and sized to secure to the integral hook 24 of the second opposed terminus 34 of the mounting plate 13.

The improved mounting harness 10 of this invention comprises a one piece wide strap 26, a mounting plate 13 having strap 26 permanently secured at a first strap terminus 27 to plate 13, and a slidable adjustable buckle 29 hookably secured at slot 33 to the second terminus hook 24 of plate 13. A centrally disposed and secured shallow holding chamber 16 is secured by an internal collar 17, and locked by a rotatable large diameter split washer 20 which slips into and locks the chamber 16 and collar 17 together through the aperture 18. The holding chamber 16 and the chamber top 19 secure the hoop 12 inserted in slotted apertures 14 and 15.

The improved mounting harness 10 provides finger tip rotation of the hoop 12, and the ball 11 by simply pushing hoop 12 and the cooperatively locked chamber 16 assembly to any angular position.

Many modifications in the mounting harness device can be made in the light of our teachings. It is understood that within the scope of the claims, the invention can be practiced otherwise than as described.

We claim:

1. An improved mounting harness combination for an amusement and exercise ball device, comprising:

a single wide strap having a first strap terminus and a second strap terminus, a mounting plate having a first plate terminus, a second plate terminus, and a centrally located selected diameter circular aperture, said first plate terminus having a narrow slot disposed adjacent said first plate terminus and said first strap terminus permanently secured around said first plate terminus, said second plate terminus having an integral hook formed thereon from said terminus plate, said centrally located aperture having a shallow holding chamber and having a collar secured respectively on each side of said aperture, said chamber rotatably locked in said aperture by a split washer secured between said mounting plate and said collar, said holding chamber having a chamber top secured on said chamber by fasteners, said chamber top and said holding chamber providing a slotted holding means for a hoop to which a ball is rotatably secured, and, an adjustable buckle disposed and secured on and adjacent to said second strap terminus, said buckle having a first terminal narrow slot disposed therein of a width slidably accepting said strap, said buckle having a second parallel mid-width strap slot having projections extending into said slot securing said strap and preventing its slippage, and a second terminal slot adapted and sized to secure said integral hook formed and disposed in said second plate terminus, said mounting harness providing finger tip rotation of said hoop, locked into said shallow holding chamber, to any angular disposition on said plate.

2. An improved mounting harness combination for an amusement and exercise ball device, comprising:

a single wide strap having a first strap terminus and a second strap terminus, and, a mounting plate having a first plate terminus, a second plate terminus, and a centrally located selected diameter circular aperture, said first plate terminus having a narrow slot disposed adjacent said first plate terminus and said first strap terminus permanently and slidably secured around said first plate terminus, said second plate terminus having an integral hook formed thereon from said terminus plate, said centrally located aperture having a shallow holding chamber and having a collar secured respectively on each side of said aperture, said chamber rotatably locked in said aperture by a split washer secured between said mounting plate and said collar, said holding chamber having a chamber top secured on said chamber by fasteners, said chamber top and said holding chamber providing a slotted holding means for a hoop to which a ball is rotatably secured, said mounting harness providing finger tip rotation of said hoop, locked into said shallow holding chamber, to angular disposition on said plate.

3. In the improved mounting harness combination set forth in claim 2, the further modification wherein, an adjustable buckle disposed and secured on and adjacent to said second strap terminus, said buckle having a first terminal narrow slot disposed therein of a width slidably accepting said strap, said buckle having a second parallel mid-width strap slot having projections extending into said slot secured said strap and preventing its slippage, and a second terminal slot adapted and sized to secure said integral hook formed and disposed in said second plate terminus.

* * * * *